United States Patent [19]

Gomi et al.

[11] Patent Number: 4,522,627

[45] Date of Patent: Jun. 11, 1985

[54] PROCESS FOR PRODUCING OIL-CONTAINING, MICROSPHERICAL CARBONACEOUS PARTICLES

[75] Inventors: Shimpei Gomi, Tokyo; Tomomitsu Takeuchi, Yokohama; Itaru Matsuo, Matsudo; Toshio Tsutsui; Takao Nakagawa, both of Ichikawa; Shigeru Miwa, Ichihara, all of Japan

[73] Assignee: Fuji Standard Research Kabushiki Kaisha, Tokyo, Japan

[21] Appl. No.: 447,289

[22] Filed: Dec. 6, 1982

[30] Foreign Application Priority Data

Dec. 28, 1981 [JP] Japan ..... 56-209986

[51] Int. Cl.[3] ..... C10L 9/00; C10L 9/10; C10L 5/00; C10L 5/16

[52] U.S. Cl. ..... 44/1 R; 44/6; 208/39; 252/385

[58] Field of Search ..... 44/1 R, 6; 208/39; 252/385

[56] References Cited

U.S. PATENT DOCUMENTS 3,197,413 7/1965 Wingerd ..... 208/39
3,235,483 2/1966 McCoy et al. ..... 208/39

FOREIGN PATENT DOCUMENTS 34198 2/1982 Japan ..... 44/1 R

*Primary Examiner*—Patrick P. Garvin
*Assistant Examiner*—Chung K. Pak
*Attorney, Agent, or Firm*—Wyatt, Gerber, Shoup, Scobey and Badie

[57] ABSTRACT

Molten pitch is mixed and atomized in an inert gas stream having a temperature less than that of the molten pitch, cooled to the ordinary temperature and separated from the gas stream.

Fine powder such as carbon, silica alumina and the like is added to at least one step of the process to improve the fluidity of the thusly obtained fine solid pitch spheres. The pitch spheres are easy to storage, handle and transport as they behave like a fluid.

7 Claims, 1 Drawing Figure

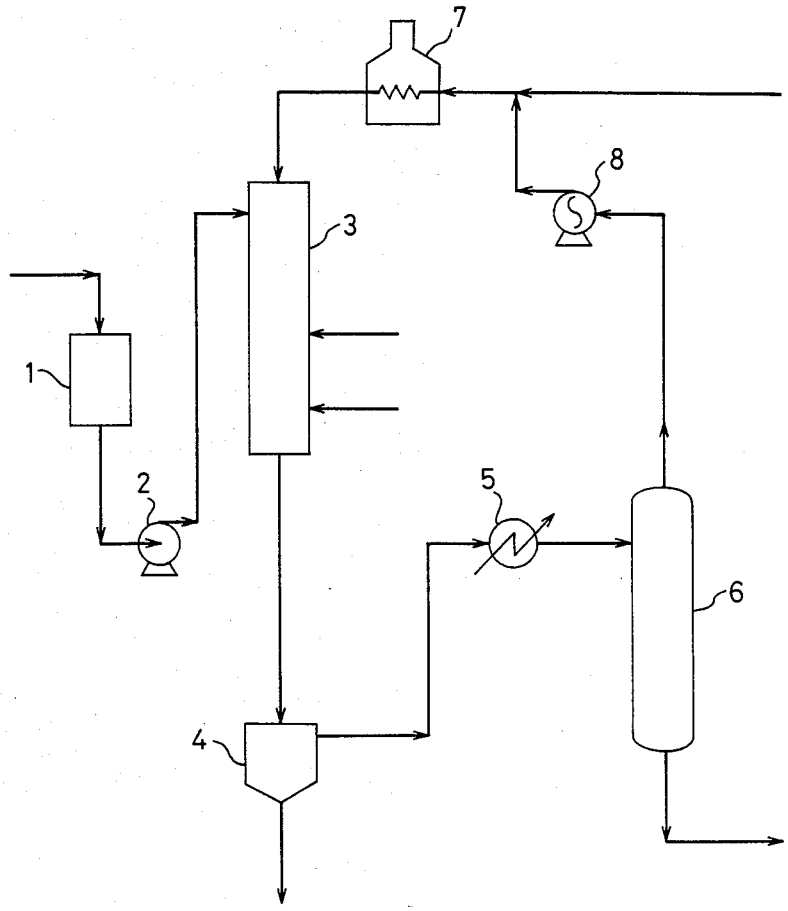
7
8
3
1
2
5
6
4

PROCESS FOR PRODUCING OIL-CONTAINING, MICROSPHERICAL CARBONACEOUS PARTICLES

DETAILED DESCRIPTION OF THE INVENTION

This invention relates to a process for producing microspherical pitch particles, and more specifically to a process for producing oil-containing, microspherical pitch particles made of any of pitches from processes for treating petroleum, coal or the like, or from naturally occurring bitumen or asphalt, and which can be handled as easily as a fluid for convenience in transportation and storage.

Pitches are available in abundance from the processes for treating and refining petroleum, coal and the like. For example, treatments of petroleum bottom (residual) oils, tar sands, and oil shales, and coal coking and liquefaction processes afford pitches. Besides, there occur bitumen and asphalts in nature. Part of these pitches is in use, after appropriate treatments, for varied applications, e.g., as binder pitches for electrodes, steelmaking and other purposes, electrode coke, solid fuels such as carbonaceous and other cokes, and as feedstocks for fuel gas and hydrogen gas production.

However, as is well-known with the naturally occurring bitumen and asphalts, those pitches are either viscous liquids or solids which become viscous as the temperature rises. The inherent viscosities make them difficult to handle for transportation and storage, thus limiting their fully effective utilization.

The present invention provides a novel, spherical pitch product which eliminates the disadvantages of the currently available pitches and permits easy handling like a fluid without adhesiveness. The pitch spheres, so easy to transport and store, are much helpful in settling the problems in processes for treating heavy distillates and bottoms to which increasing importance is being attached. Of the crude oils in production and on market, heavy ones are accounting for increasing percentages, while another tendency is a gradual shift in demand from heavy to light and lighter petroleum products. Consequently, there is an urgent need for expanding the capacities of processes for converting and upgrading heavy or bottom oils to lighter materials. In the meantime, early development of substitute energy for petroleum is being called for. Attempts to recover oils from tar sands and oil shales and development of new coal liquefaction processes are also under way. Heavy distillates or oils from these sources are fed, too, to the heavy-to-light conversion and upgrading processes. Those processes naturally give carbonaceous residues, which present a number of handling and application problems yet to be solved with the existing installations for the heavy oil treating processes.

This will be explained, by way of example, in connection with typical processes for treating petroleum bottom oils, namely, delayed coking, Eureka process, fluid coking, and flexicoking. Delayed coking, which is a semibatch process, produces residual green coke in coke drums which must be broken into lumps and taken out at regular intervals by hydraulic or mechanical means. The lumps are difficult to discharge, and the product coke is inconvenient to transport and store because of its moisture and suchlike contents, irregular shape, and low fluidity. The product also involves difficulties in use as fuel. Eureka process, again for semibatch operation, yields residual pitch in a liquid form, which can be continuously taken out and cooled solid by a flaker for use as binder for iron and steel. Although the residue the process gives is a pitch easy to take out, it still entails some inconvenience in transportation and storage. Moreover, in the present state of the art, there is a quantitative limit to the application of the pitch as the binder or the like. Fluid coking gives coarse coke pieces as the residue, but because relatively high temperatures are used in processing, the coke has rather poor combustibility and hence its value as fuel is low. Flexicoking gasifies the residual coke pieces obtained above. The gasified product is convenient for transportation but not for storage. In addition, the gas is low in calorific value and is limited in use as fuel.

The present inventors conceived the idea of continuously taking out of the system, in the form of pitch, the carbonaceous residue that consequently results from a process of treating heavy residual bottoms and then forming the pitch into microspherical pitch particles that can be handled like a fluid, in the belief that the product would then be convenient for transportation and storage, usable directly as fuel in many cases, and be efficiently gasifiable when necessary, thus contributing greatly to the utilization of the carbonaceous residue from the bottoms treating process that leave many problems yet to be solved. Intensive investigations based on the concept have now led to the provision of a process for producing pitch spheres capable of solving the problems pertaining to the bottom oil treating process.

The pitch spheres made in accordance with this invention are minute and are highly fluid without any tendency of sticking to one another. Moreover, they are spherical in shape, and the mass of the spheres behaves like a fluid. Thus, ease of handling, transportation, and storage characterizes the spheres of the invention.

The pitch spheres are substantially free of moisture and, in many cases, low in ash content. They can, therefore, be fired directly without the need of pulverization as special fuel by a burner of a universal type through some modification of the spherical pitch properties. An additional advantage is that the combustibility can be controlled through adjustment of the oil (volatile matter) content of the pitch spheres.

Further, thermal cracking of the spherical pitch by use of a fluidized-, movable-, or fixed-bed technique will decompose part of its oil content to lighter products which are separable. The remainder is thermally polymerized to form green coke spheres. This product, having minute pores, can be employed directly as fuel, e.g., for kilns. It is easily gasified for use as fuel or as desirable feed for hydrogen gas production. The microspherical shape again renders the green coke particles convenient for handling, transportation, and storage.

The pitch spheres of the invention are made from a liquid material pitch having a softening point of 80°–220° C. and a fixed carbon content of 40–75 wt % by (1) atomization and granulation of the pitch into spheres and cooling for solidification of the resulting spheres, all under substantially non-evaporative conditions, and (2) addition of a powder for improving the fluidity of the pitch spheres during the granulation or in a subsequent step of treating the pitch spheres so obtained.

The atomization and granulation of the pitch and the cooling and solidification of the resulting spheres are performed in the following way. The material pitch is heated and melted at 120°–430° C. to a relatively low viscosity. The molten pitch is mixed into a stream of a gas substantially inert to the pitch by means of a two-fluid nozzle, high-pressure nozzle, disk-type atomizer or the like. When a two-fluid nozzle is used the pitch is atomized at a high relative velocity of the pitch and gas streams. When a high-pressure nozzle or disk-type atomizer is used high relative velocity is not required. The atomized pitch is cooled to solid spheres, if necessary, with the aid of spraying of water or other cooling medium.

The temperature of the material pitch is in the range of 120°–430° C. At below I 120° C. the pitch generally is too viscous for smooth atomization, and above 430° C. the pitch quality is adversely affected by the heat.

The viscosity of the material pitch at such temperatures cannot be generally specified because it varies with the type of the atomizing mechanism to be used. If the spherical particles are to have an average particle diameter in the range of 30–200 μm, the pitch viscosity should be usually 1000 cps or below, desirably below 300 cps. The viscosity is usually adjusted by controlling the heating temperature; a small addition of a hydrocarbon distillate is also effective.

The term "inert gas" as used herein means a substantially inert gas not chemically reactive with pitches. Examples are fuel gases containing methane, nitrogen gas, carbon dioxide gas, steam, combustion waste gases, and air heated to temperatures at which it is substantially inert to pitches. When desired, a mixture of such gases may be employed as well.

The temperature of the inert gas should be such that the decomposition reaction of the pitch and the evaporation of oily matter or the like from the pitch can be practically disregarded, i.e., in the range from the ordinary temperature to 430° C. and below the temperature of the molten pitch with which it is to be mixed. If the gas temperature is higher than necessary, excessive cooling with water spray or the like is needed to an economic disadvantage, whereas a too low gas temperature renders it sometimes impossible to obtain perfectly spherical pitch particles. The gas temperature must be suitably controlled according to the properties of the material pitch.

The inert gas is used in an amount 0.3–15 times, usually 0.5–8 times, (weight ratio) that of the pitch spheres. If the gas quantity is insufficient, aggregaion of the particles or deposition of the particles on the atomizer walls can take place. A gas quantity beyond the range is undesirable because of poor economy of the process.

When a two-fluid nozzle is used, the linear velocity of the inert gas in the region where it is mixed with the pitch is not lower than 50 m/sec, preferably not lower than 100 m/sec. Equally, the relative velocity of the pitch and the inert gas in the same region is 50 m/sec or above, preferably 100 m/sec or above. Controlling the velocities within these ranges is important in that it permits effective mixing and atomization of the liquid pitch, promotes heat transfer from the pitch to the gas, and shortens the contact time. When a high-pressure nozzle or a rotary disk atomizer is used the velocity is not important.

Spraying water, liquefied coal gas, or other cooling medium over the mixture of pitch particles and inert gas is effective in accelerating the cooling of pitch by use of the latent heat of evaporation of the medium, decreasing the quantity of the inert gas to be consumed, and reducing the size of the equipment.

Under the conditions specified above, the period of time in which the pitch in the atomizer is mixed and atomized and then cooled and solidified is not more than 5 seconds, preferably not more than one second.

The pitch spheres thus formed can be separated from the gas by mechanical means, such as a cyclone or bag filter.

The process pressure for the granulation, which varies with the ratio of the quantity of the inert gas to that of the pitch spheres, is not lower than the ordinary level, desirably from the atmospheric pressure to 10 kg/cm$^2$. If the pressure is below this range, the gas volume becomes too large, necessitating a larger equipment and adding to the cost. A pressure in excess of the range is again undesirable because of growing tendencies toward impingement among the particles for aggregation or deposition on atomizer walls.

In order to make the pitch spheres practically nonadhesive and improve their fluidity, a powdery substance is added to the spheres in accordance with the invention. The powder to be added is any of fine carbonaceous powders, or any of fine powders of the oxides, hydroxides, and salts of at least one of the elements Si, Al, Ca, Fe, and Mg. For example, fine powder of a carbon black, powdered active carbon, powdered graphite, silica, alumina, clay, diatom earth, zeolite, or talc, which is adsorptive or capable of sucking up any oily matter present on the pitch sphere surfaces is employed. Such a powder not merely adsorbs the oily matter but, in addition, acts as a lubricant to improve the fluidity of pitch spheres remarkably. The powder may be added either together with the gas for mixing and atomization in the granulation stage or after the atomization of the pitch. It is also easy to add it to the pitch spheres formed, in the course of their separation from the gas, or by use, e.g., of the fluidized-bed technique. The amount of the powder to be added is not specifically defined because it varies with the kind of the powder and the properties of the pitch spheres, but usually an amount in the range of 0.05–100% (by weight), or generally 1% or less, on the basis of the pitch sphere weight is sufficient. The powder so added may be separate from, or mixed with, the pitch spheres.

The pitch spheres formed by the process of the invention has an average particle diameter (mean of 50% by weight) of 30–200 μm, oil content of 60–25 wt %, fixed carbon content of 40–75 wt % (as measured in conformity with the Japanese Industrial Standards M-8812), softening point of not lower than 80° C., and solids flow rate of up to 200 sec/15 g. Thus, the product is in the form of practically nonadhesive, excellently fluid particles.

The softening point given above, measured with a Simadzu-Koka flow tester (manufactured by Shimadzu Seisakusho, Ltd.), indicates that the particles can retain their spherical form under compression of 10 kg/cm$^2$ at ordinary temperatures.

The fluidity (solids flow rate) was measured in conformity with JIS Z-2502, using a specified measuring funnel (with a conical angle of 60°–10", orifice dia. of 2.63 mm, orifice length of 3.2 mm, and with a standard specimen of Alundum A#100 having a solids flow rate of 36.0 sec/50 g). The measured value represents the time (sec.) required for 15 g of a test specimen to flow down gravitationally through the funnel.

The compositional values, given in terms of the oil content, fixed carbon, etc., of the pitch spheres are all average values. Individual particles may have a composition uniform throughout or may be ununiform in composition with a greater oil content (less fixed carbon content) in the center than in the periphery, as though having a spherical skin.

For the pitch spheres the average diameter (mean of 50% by weight) is in the range of 30–200 μm. If the diameter is less than 30 μm, the particles tend to aggregate, especially in a fluidized state. If the diameter is above 200 μm, particularly where they flow together with the gas, the particles will exhibit inadequate smoothness, which is undesirable for transportation, storage, or fluidization.

The starting material for producing the pitch spheres of the invention may be any of the pitches from the petroleum thermal cracking processes and heavy bottom (residual) oil treating processes, e.g., Eureka process and solvent deasphalting (SDA) process, naturally occurring ditumen and asphalts and other petroleum pitches, coal pitches produced by coal coking and liquefying processes (e.g., SRC process), and various other pitches. The pitches to be used should have a softening point in the range of 80°–220° C., preferably in the range of 100°–180° C., and a fixed carbon content (as measured in conformity with JIS M-8812) of 40–75 wt %. If the softening point is below 80° C. or the fixed carbon content is less than 40 wt %, the material is not suited for the production of the pitch spheres of the invention, because of its adverse effect on the nonstickiness, strength, etc. of the product pitch spheres.

A typical method of producing the pitch spheres of the invention will be described below with reference to a flow chart in the accompanying drawing. The description of the method is illustrative only for better understanding of the present invention, and not restrictive in any way to the process of the invention for producing pitch spheres.

Material pitch 1, melted at 120°–430° C. and kept in a suitably viscous state in a material tank 1, is fed by a pump 2 to an atomizer 3. Inside the atomizer, the molten pitch at a temperature from the ordinary to 430° C. is injected for atomization into a stream of an inert gas at the same or lower temperature. The atomizer 3 is of a venturi type, which injects the liquefied pitch through a plurality of pressure nozzles countercurrently to a high speed stream of the inert gas whose linear velocity is at least 50 m/sec in the region where it mixes with the pitch. Carbon black is added to the mixed stream of the atomized pitch and the gas, and then water is sprayed over the mixed stream to accelerate its cooling, so that the pitch particles are cooled and solidified to spheres. The product pitch spheres and the gas are separated by a cyclone 4. The gas is led to a condenser 5, where its moisture content is condensed, and is freed from the water in a condensed-water separating tank 6, and then, where necessary, the moisture-free gas is heated to a suitable temperature in a heating oven 7 and is recycled to the atomizer.

EXAMPLE 1

The starting material was a residue obtained by extracting a vacuum residue of a Middle East crude with n-pentane as the solvent. Its properties were as shown in Table 1.

TABLE 1

| | |
|---|---|
| Softening point, °C. | 153 |
| Oil content, wt % | 41.2 |
| Fixed carbon content, wt % | 58.8 |

TABLE 1-continued

| | |
|---|---|
| Elementary analysis values, wt % | |
| C | 83.3 |
| H | 8.1 |
| N | 1.0 |
| S | 7.2 |
| H/C (atomic ratio) | 1.17 |

This material pitch was heated to 330° C. (at which it attained a viscosity of 150 cps), and was atomized by spraying with nozzles, at a flow rate of 7 kg/hr, into a stream of nitrogen gas heated at 300° C. The flow rate of the nitrogen gas was 11 $Mn^3$/hr.

The atomizer used was of a venturi type having a gas inlet 8 mm in inside diameter, a constriction 6 mm in inside diameter, and 1500 mm in length. A bank of two 0.5 mm-dia. nozzles was installed immediately upstream of the constriction. The material pitch was issued out of the nozzles countercurrently (at an angle of 45°) to the stream of nitrogen gas. The linear velocity of nitrogen at the constriction was about 150 m/sec. The nozzle pressure for injection of the feedstock was about 3 $kg/cm^2G$.

Carbon black was added at a rate of 70 g/hr to the mixed stream of pitch and nitrogen, and then water at 30° C. was injected at a rate of about 2.7 kg/hr to rapidly cool the mixture down to about 110° C. Through the cyclone the mixture was separated into a gas stream and pitch spheres.

The pitch spheres thus obtained had an average particle diameter of about 90 μm (90% of the product being in the 30–150 μm range), softening point of 156° C., and a solids flow rate of 43 sec/15 g. The yield was 96.5 wt %.

The physical properties of the carbon black added were as given in Table 2.

TABLE 2

| | |
|---|---|
| Average particle diameter, μm | 27 |
| Surface area, $m^2/g$ | 80 |
| Iodine adsorption mg/g | 81 |
| Volatile content, wt % | 1.2 |
| Ash content, wt % | 0.3 |

As a modification of this example, the same process was repeated using the same starting pitch except that the atomizer in this example was so modified that it had a length of 3,000 mm, the wall downstream of the constriction diverged downwardly to form a dome terminating in a maximum diameter of 700 mm and the pitch injection nozzles were mounted on the dome portion immediately downstream of the constriction at right angle with respect to the axis of the atomizer. The result was similar to that of this example.

EXAMPLE 2

A pitch obtained by thermal cracking of a vacuum residue was used as the starting material. Its properties were as shown in Table 3.

TABLE 3

| | |
|---|---|
| Softening point, °C. | 179 |
| Oil content, wt % | 39.6 |
| Fixed carbon content, wt % | 60.4 |
| Elementary analysis values, wt % | |
| C | 87.1 |
| H | 5.7 |
| N | 1.4 |
| S | 5.6 |

TABLE 3-continued

| | |
|---|---|
| H/C (atomic ratio) | 0.79 |

This material pitch was heated and melted at 360° C. (at which it had a viscosity of 400 cps), and was atomized by spraying with nozzles, at a flow rate of 7 kg/hr, into a stream of nitrogen gas heated at 350° C. The inert gas, supplied at a flow rate of 18.7 kg/hr, had a composition as given in Table 4.

TABLE 4

| Analytical values, vol % | |
|---|---|
| $H_2$ | 5.0 |
| $CH_4$ | 50.8 |
| $C_2H_6$ | 22.8 |
| $C_3H_8$ | 15.4 |
| $C_4H_{10}$ | 6.0 |

The atomizer was of a venturi type similar to the one used in Example 1, with a gas inlet inside diameter of 8 mm, constriction inside diameter of 6 mm, and a length of 1500 mm. Two 0.5 mm-dia. nozzles were installed immediately ahead of the constriction, and the material pitch was injected by the nozzles countercurrently (at an angle of 45°)to the gas stream. The linear velocity of the gas at the constriction was about 250 m/sec. The nozzle pressure for the injection of material pitch was about 3 kg/cm$^2$G.

The mixed gaseous stream of pitch and inert gas was rapidly cooled to about 110° C. by injecting water at 30° C. into the stream at a rate of 6.7 kg/hr. The cooled mixture was led to the cyclone, where it was separated into a gas stream and pitch spheres. The spheres were obtained in a yield of 97.0 wt %.

Five kilograms of the pitch spheres thus formed was charged into a horizontal, rotating drum mixer having a capacity of 30 liters. After the addition of 40 g carbon black, the charge was mixed at a rotational speed of 100 rpm for 3 minutes, and product pitch spheres were obtained.

The pitch spheres had an average particle diameter of about 100 μm (92% of the product being in the 30–160 μm range), softening point of 183° C., and solids flow rate of 40 sec/15 g.

The carbon black added was the same as that employed in Example 1, with the physical properties shown in Table 2.

Under conditions similar to those used in the above examples, small quantities of porous alumina, porous silica, calcium hydroxide, talc, graphite, diatom earth, clay, and zeolite powders were added, one for each, to different portions of the pitch spheres. All the additives proved markedly effective in improving the fluidity of the pitch spheres.

While some embodiments of the invention have been described, it will be obvious to those skilled in the art that various changes and modifications may be made within the scope of the invention.

BRIEF DESCRIPTION OF THE DRAWING

The single FIGURE is a flow chart of arrangements suited for practicing the process of the invention. The reference numerals designate the following parts:

1=material tank; 2=pump; 3=atomizer;
4=cyclone; 5=condenser; 6=cpmdemsed-water separating tank;
7=heating oven; 8=blower.

We claim:

1. A process for producing pitch spheres substantially free of moisture having a softening point of at least 80° C., solid flow rate of at least 200 sec/15 μg, and an average particle diameter from 30–200 μm, which comprises heating and melting at 120°–430° C. a material pitch selected from the group consisting of petroleum and coal pitches having fixed carbon contents of 40–75 wt % and softening points of 80°–220° C., mixing and atomizing the molten pitch in a stream of an inert gas at a pressure from atomospheric to 10 kg/cm$^2$ and at a temperature lower than that of the molten pitch, cooling and solidifying said atomized pitch by further lowering the temperature of said mixture of said atomized pitch and inert gas by spraying a cooling medium into the mixture in a quantity such that it evaporates and its latent heat of vaporization is used to obtain said spheres substantially free of moisture, and adding a fine powder having a fluidity-improving effect on said pitch spheres in a quantity of from 0.05 to 1% based on the weight of the pitch spheres in at least one of said pitch sphere forming steps and separating step.

2. A process according to claim 1 wherein the liquid cooling medium is water.

3. A process according to claim 1 or 2 wherein the amount of said gas for mixing and atomizing use is from 0.3 to 15 times (by weight) that of said pitch to be mixed therewith.

4. A process according to claim 1 or 2 wherein the period of time in which said gas and said material pitch are mixed for atomization and the atomized pitch is cooled to solid spheres is not longer than one second.

5. A process according to claim 1, or 2 wherein said fine powder is selected from the group consisting of carbon and oxides, hydroxides, and salts of at least one of the elements Si, Al, Ca, Fe, and Mg.

6. A process according to claim 1 or 2 wherein said fine powder is carbon black or powdered active carbon.

7. A process according to claim 1 or 2 wherein said fine powder is selected from the group consisting of calcium hydroxide, talc, diatom earth, clay, and zeolite.

* * * * *

UNITED STATES PATENT AND TRADEMARK OFFICE

CERTIFICATE OF CORRECTION

PATENT NO. : 4,522,627

DATED : June 11, 1985

INVENTOR(S) : GOMI ET AL

It is certified that error appears in the above—identified patent and that said Letters Patent is hereby corrected as shown below:

Claim 1, line 3 - change "at least 200 sec/15 ug" to read ---up to 200 sec/15 g---

Signed and Sealed this

*Fifth* Day of *November 1985*

[SEAL]

*Attest:*

*Attesting Officer*

DONALD J. QUIGG

*Commissioner of Patents and Trademarks*